US010508017B2

(12) United States Patent
Al Khowaiter et al.

(10) Patent No.: US 10,508,017 B2
(45) Date of Patent: Dec. 17, 2019

(54) POINT-OF-SALE OCTANE/CETANE-ON-DEMAND SYSTEMS FOR AUTOMOTIVE ENGINES

(71) Applicant: Saudi Arabian Oil Company, Dhahran (SA)

(72) Inventors: Ahmad O. Al Khowaiter, Dhahran (SA); Esam Z. Hamad, Dhahran (SA); Husain A. Baaqel, Dhahran (SA); Amer A. Amer, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 104 days.

(21) Appl. No.: 15/783,031

(22) Filed: Oct. 13, 2017

(65) Prior Publication Data

US 2019/0112178 A1 Apr. 18, 2019

(51) Int. Cl.
*B67D 7/04* (2010.01)
*B67D 7/10* (2010.01)
(Continued)

(52) U.S. Cl.
CPC ..... *B67D 7/04* (2013.01); *B67D 7/10* (2013.01); *B67D 7/62* (2013.01); *B67D 7/743* (2013.01); *B67D 7/78* (2013.01); *C10L 1/04* (2013.01); *B67D 7/16* (2013.01); *B67D 7/38* (2013.01); *B67D 2007/746* (2013.01); *B67D 2007/748* (2013.01); *C10G 2300/305* (2013.01); *C10G 2300/307* (2013.01)

(58) Field of Classification Search
CPC ... B67D 7/04; B67D 7/06; B67D 7/74; B67D 2007/745; B67D 2007/747; B67D 7/76; B67D 7/743
See application file for complete search history.

(56) References Cited

U.S. PATENT DOCUMENTS 3,985,108 A 10/1976 Matsumoto et al.
4,212,276 A 7/1980 Kaneda
(Continued)

FOREIGN PATENT DOCUMENTS

CN 102399602 A 4/2012
CN 202226834 U 5/2012
(Continued)

OTHER PUBLICATIONS

Notice of Allowance dated Apr. 11, 2019 pertaining to U.S. Appl. No. 15/885,084, filed Jan. 31, 2018, 13 pgs.
(Continued)

*Primary Examiner* — Timothy P. Kelly
(74) *Attorney, Agent, or Firm* — Dinsmore & Shohl, LLP

(57) ABSTRACT

A point-of-sale fuel dispensing system, a pump assembly and a method of dispensing fuel at a point-of-sale. The system includes a market fuel storage tank, pump assembly, fuel conduit, separation unit, numerous enriched fuel product tanks and a controller. The separation unit may selectively receive at least a portion of market fuel and convert it into an octane-rich fuel component and a cetane-rich fuel component that may be subsequently dispensed to a vehicle being fueled, where a fuel grade selection and retail payment of a fuel containing the octane-rich or cetane-rich fuel components is provided to the vehicle based on user input at the customer interface.

24 Claims, 7 Drawing Sheets

(51) Int. Cl.

| | |
|---|---|
| ***B67D 7/62*** | (2010.01) |
| ***B67D 7/74*** | (2010.01) |
| ***B67D 7/78*** | (2010.01) |
| ***C10L 1/04*** | (2006.01) |
| *B67D 7/16* | (2010.01) |
| *B67D 7/38* | (2010.01) |

(56) References Cited

U.S. PATENT DOCUMENTS

| | | | | |
|---|---|---|---|---|
| 4,308,841 | A | 1/1982 | Kingsley | |
| 4,963,745 | A | 10/1990 | Maggard | |
| 5,018,645 | A | 5/1991 | Zinsmeyer | |
| 5,132,486 | A | 7/1992 | Wylie | |
| 5,357,908 | A | 10/1994 | Sung et al. | |
| 5,649,517 | A | 7/1997 | Poola et al. | |
| 5,794,601 | A | 8/1998 | Pantone | |
| 5,921,263 | A * | 7/1999 | Negley, III | B67D 7/744 137/3 |
| 5,979,705 | A | 11/1999 | Kaehler et al. | |
| 6,055,808 | A | 5/2000 | Poola et al. | |
| 6,067,973 | A | 5/2000 | Chanda et al. | |
| 6,112,134 | A | 8/2000 | Terranova et al. | |
| 6,119,637 | A | 9/2000 | Matthews et al. | |
| 6,161,060 | A | 12/2000 | Collins | |
| 6,163,738 | A | 12/2000 | Miller | |
| 6,173,567 | B1 | 1/2001 | Poola et al. | |
| 6,230,693 | B1 | 5/2001 | Meiller et al. | |
| 6,332,448 | B1 | 12/2001 | Ilyama et al. | |
| 6,352,068 | B1 | 3/2002 | Jacobsen | |
| 6,380,859 | B1 | 4/2002 | Brownlee | |
| 6,422,465 | B2 | 7/2002 | Miller | |
| 6,494,192 | B1 | 12/2002 | Capshaw et al. | |
| 6,505,134 | B2 | 1/2003 | Poleshuk et al. | |
| 6,543,687 | B2 | 4/2003 | Negley | |
| 6,742,507 | B2 | 6/2004 | Keefer et al. | |
| 6,972,093 | B2 | 12/2005 | Partridge et al. | |
| 7,032,629 | B1 | 4/2006 | Mattingly et al. | |
| 7,100,543 | B2 | 9/2006 | Davidson | |
| 7,370,610 | B2 | 5/2008 | Ashford et al. | |
| 7,377,272 | B2 | 5/2008 | Davidson | |
| 7,455,046 | B2 | 11/2008 | Biruduganti et al. | |
| 7,459,592 | B2 | 12/2008 | Wolf et al. | |
| 7,523,770 | B2 * | 4/2009 | Horowitz | G06Q 50/30 141/94 |
| 7,900,607 | B2 | 3/2011 | Lang et al. | |
| 7,954,478 | B1 | 6/2011 | Schechter | |
| 7,958,872 | B1 | 6/2011 | Schechter | |
| 8,046,984 | B1 | 11/2011 | Schechter | |
| 8,051,828 | B2 | 11/2011 | Sengupta et al. | |
| 8,118,009 | B2 | 2/2012 | Pursifull et al. | |
| 8,141,356 | B2 | 3/2012 | Leone et al. | |
| 8,211,300 | B2 | 7/2012 | Partridge et al. | |
| 8,258,363 | B2 | 9/2012 | Kalakkunnath et al. | |
| 8,375,899 | B2 | 2/2013 | Leone et al. | |
| 8,459,238 | B2 | 6/2013 | Pursifull et al. | |
| 8,506,656 | B1 | 8/2013 | Turocy | |
| 8,580,111 | B2 | 11/2013 | Partridge et al. | |
| 8,656,869 | B2 | 2/2014 | Leone et al. | |
| 8,991,358 | B2 | 3/2015 | Gehrke | |
| 9,422,147 | B2 | 8/2016 | Bartlett et al. | |
| 9,776,624 | B1 | 10/2017 | Leone et al. | |
| 9,802,810 | B2 * | 10/2017 | Johnson | B67D 7/04 |
| 10,260,015 | B2 * | 4/2019 | Gosling | C10G 59/00 |
| 2002/0152999 | A1 | 10/2002 | Holder et al. | |
| 2004/0065076 | A1 | 4/2004 | Katoh et al. | |
| 2005/0055874 | A1 * | 3/2005 | Bekemeyer | B67D 7/74 44/629 |
| 2005/0056264 | A1 | 3/2005 | Weissman et al. | |
| 2005/0066576 | A1 | 3/2005 | Morris et al. | |
| 2005/0222748 | A1 | 10/2005 | Naik et al. | |
| 2006/0009670 | A1 | 1/2006 | Briot et al. | |
| 2006/0037589 | A1 | 2/2006 | Gupta et al. | |
| 2007/0107676 | A1 | 5/2007 | Davidson | |
| 2007/0256665 | A1 | 11/2007 | Sun et al. | |
| 2008/0041226 | A1 | 2/2008 | Hiltzik et al. | |
| 2008/0098985 | A1 | 5/2008 | Kamio | |
| 2008/0196695 | A1 | 8/2008 | Storhok et al. | |
| 2008/0202118 | A1 | 8/2008 | Ide et al. | |
| 2008/0308073 | A1 | 12/2008 | Allen et al. | |
| 2008/0308074 | A1 | 12/2008 | Allen et al. | |
| 2008/0308075 | A1 | 12/2008 | Allen et al. | |
| 2009/0165759 | A1 | 7/2009 | Sengupta et al. | |
| 2009/0255875 | A1 | 10/2009 | Unger et al. | |
| 2011/0023841 | A1 | 2/2011 | Ucke et al. | |
| 2012/0006504 | A1 | 1/2012 | Sugiura | |
| 2012/0031812 | A1 | 2/2012 | Paggi | |
| 2012/0192834 | A1 | 8/2012 | Tonery | |
| 2013/0014731 | A1 | 1/2013 | Pursifull et al. | |
| 2013/0168311 | A1 | 7/2013 | Johnson et al. | |
| 2013/0213349 | A1 | 8/2013 | Sellnau et al. | |
| 2013/0255493 | A1 | 10/2013 | Gupta | |
| 2013/0269521 | A1 | 10/2013 | Nishita et al. | |
| 2013/0289850 | A1 | 10/2013 | Johnson et al. | |
| 2015/0114362 | A1 | 4/2015 | Costa-Patry et al. | |
| 2015/0353853 | A1 | 12/2015 | Iwashita et al. | |
| 2016/0076492 | A1 | 3/2016 | Leone et al. | |
| 2016/0265493 | A1 | 9/2016 | Bima | |
| 2016/0313171 | A1 | 10/2016 | Dudar et al. | |
| 2016/0368373 | A1 | 12/2016 | Dudar et al. | |
| 2017/0122668 | A1 | 5/2017 | Fujii et al. | |
| 2017/0211532 | A1 | 7/2017 | Yamauchi et al. | |
| 2017/0234276 | A1 | 8/2017 | Hamad et al. | |
| 2017/0246614 | A1 | 8/2017 | Eddaoudi et al. | |
| 2017/0282708 | A1 | 10/2017 | Hamad et al. | |

FOREIGN PATENT DOCUMENTS

| | | | |
|---|---|---|---|
| CN | 103045285 | A | 4/2013 |
| DE | 102004049218 | A1 | 4/2006 |
| EP | 1057988 | A2 | 6/2000 |
| EP | 1832738 | A2 | 9/2007 |
| JP | 2004231296 | A | 8/2004 |
| JP | 2004277016 | A | 10/2004 |
| JP | 2010163901 | A | 7/2010 |
| WO | 2011007121 | A2 | 1/2011 |
| WO | 2017014976 | A1 | 1/2017 |

OTHER PUBLICATIONS

Notice of Allowance dated May 1, 2019 pertaining to U.S. Appl. No. 15/939,971, filed Mar. 29, 2018, 32 pgs.

Notice of Allowance dated May 13, 2019 pertaining to U.S. Appl. No. 15/939,930, filed Mar. 29, 2018, 32 pgs.

Notice of Allowance dated Mar. 11, 2019 pertaining to U.S. Appl. No. 15/475,383, filed Mar. 31, 2017, 23 pgs.

Notice of Allowability dated May 13, 2019 pertaining to U.S. Appl. No. 15/475,383, filed Mar. 31, 2017, 7 pgs.

International Search Report and Written Opinion dated May 15, 2019 pertaining to International application No. PCT/US2019/015349, filed Jan. 28, 2019, 13 pgs.

Non-Final Office Action dated Nov. 2, 2018, pertaining to U.S. Appl. No. 15/475,383, 42 pages.

International Search Report and Written Opinion pertaining to International Application PCT/US2018/023962 dated Aug. 6, 2018.

International Search Report and Written Opinion dated May 6, 2019 pertaining to International application No. PCT/US2019/015330 filed Jan. 28, 2019.

International Search Report and Written Opinion pertaining to International Application PCT/US2018/054182, dated Dec. 19, 2018, 14 pages.

U.S. Office Action pertaining to U.S. Appl. No. 15/885,084 dated Jan. 2, 2019, 20 pages.

International Search Report and Written Opinion dated Jan. 18, 2019 pertaining to International application No. PCT/US2018/052339 filed Sep. 24, 2018.

International Search Report and Written Opinion dated Jun. 26,

(56) References Cited

OTHER PUBLICATIONS 2019 pertaining to International application No. PCT/US2019/021987 filed Mar. 13, 2019.

* cited by examiner

POINT-OF-SALE OCTANE/CETANE-ON-DEMAND SYSTEMS FOR AUTOMOTIVE ENGINES

BACKGROUND

The present disclosure relates generally to providing enriched octane and cetane fuels for vehicular use, and more particularly to separating a single market fuel into enriched octane and cetane fuels for use in a vehicle at the point of retail sale.

SUMMARY

Petroleum refineries employ a sophisticated set of disparate systems and their components to convert raw crude into various useful distillates, including liquefied petroleum gas (LPG), gasoline, kerosene, diesel fuel, paraffins, waxes, asphalt, tar or the like. Examples of processes used in a conventional refinery include coking, visbreaking, catalytic cracking, catalytic reforming, hydroprocessing, alkylation and isomerization. With particular regard to transportation fuels such as diesel fuel and gasoline, supplemental operations such as fuel blending, fuel additives or the like may be employed at the refinery in order to meet particular goals for octane or cetane ratings, volatility, stability, emissions control or the like.

Continuous improvement in internal combustion engine (ICE) design and control has led to increasingly sophisticated diesel fuel and gasoline grades as a way to tailor such fuels to these ICEs for optimum performance. Examples of such ICEs include gasoline compression ignition (GCI) engines, homogeneous charge compression ignition (HCCI) engines and reactivity controlled compression ignition (RCCI) engines, as well as operability improvements to traditional diesel compression ignition (CI) and gasoline spark ignition (SI) engines. Furthermore, regardless of whether an ICE using a particular fuel employs the most updated designs, a typical end use in a vehicle will need to take into consideration a wide range of vehicle types, driving conditions and driving styles. Unfortunately, the scale and relative inflexibility of refinery operations renders it almost impossible for them to apply frequent incremental changes to their infrastructure in an attempt to continue to deliver fuels matched to the needs of these new engines. In particular, retrofitting an existing refinery necessitates large investments in capital, as well as significant non-productive down time, while building entirely new refining capability requires an even larger investment in time and capital. Moreover, the economy of scale dictates that the large volume of production available from a conventional refinery is best served by producing a very limited number of fuel grades in an attempt to homogenize rather than customize the finished product for retail sale to the end consumer.

With on-site blending, a retail purchaser may select from one of a few options of fuel grade with which to dispense to his or her SI-powered vehicle by selecting a button on a pump assembly or related fuel dispensing apparatus. This blending pushes the extra infrastructure cost farther down the oil supply chain. In particular, in order to accommodate the need for such tailored fuels at the final end-use, the point-of-sale retailer needs to have a ready supply of different grades of market fuel from which such on-site blending operations may proceed. This in turn necessitates providing a concomitant number of market fuel storage tanks that may be impractical or cost-prohibitive for a retailer to install and maintain, especially in an environment where the retail fueling station is situated on a small plot of real estate, or when it is situated within a high cost-of-living area.

According to one embodiment of the present disclosure, a point-of-sale fuel dispensing system includes a market fuel storage tank, pump assembly, fuel conduit, separation unit, numerous enriched fuel product tanks and a controller. The pump assembly includes a customer interface for retail payment and fuel grade selection, as well as a nozzle that can provide selective fluid coupling to a fuel supply port of an adjacent vehicle. The fuel conduit is coupled to the pump assembly and the market fuel storage tank to permit selective fluid communication between the two of them. The separation unit is arranged such that it may selectively receive and convert at least a portion of the market fuel into an octane-rich fuel component and a cetane-rich fuel component. The enriched fuel product tanks are situated fluidly intermediate the separation unit and the pump assembly, and include a first enriched fuel product tank for selectively receiving and containing the octane-rich fuel component and a second enriched fuel product tank for selectively receiving and containing the cetane-rich fuel component. The controller is cooperative with one or more of the market fuel storage tank, pump assembly, fuel conduit, separation unit and enriched fuel product tanks to direct the flow of at least a portion of at least one of the octane-rich fuel component and cetane-rich fuel components contained within a respective one of the first and second product tanks through the nozzle based on user input at the customer interface for both retail payment and fuel grade selection for the vehicle. In addition, the controller ensures that the directed flow does not exceed a fuel capacity of the vehicle.

According to another embodiment of the present disclosure, a pump assembly for a retail point-of-sale fuel dispensing system is disclosed. The pump assembly includes a customer interface for retail payment and fuel grade selection, a nozzle configured to provide selective fluid coupling to a fuel supply port of an adjacently-situated vehicle, fuel conduit configured to convey at least a portion of fuel contained within a market fuel storage tank to one or both of the pump assembly and the vehicle, a separation unit configured to selectively receive and convert at least a portion of the fuel into an octane-rich fuel component and a cetane-rich fuel component, and various enriched fuel product tanks disposed fluidly intermediate the separation unit and the pump assembly such that a first of the enriched fuel product tanks may receive and contain the octane-rich fuel component while a second of the enriched fuel product tanks may receive and contain the cetane-rich fuel component.

According to yet another embodiment of the present disclosure, a method of dispensing fuel at a point-of-sale is disclosed. The method includes converting at least some of a market fuel that is stored in an underground storage tank that is situated at the point-of-sale into an octane-rich fuel component and a cetane-rich fuel component, and then conveying one or more of the market fuel, the octane-rich fuel component and the cetane-rich fuel component to a vehicle through a pump assembly and fuel conduit. The pump assembly includes a customer interface for both retail payment and fuel grade selection for the vehicle. A separation unit receives at least a portion of the market fuel and converts it into the octane-rich fuel component and the cetane-rich fuel component for placement into a first enriched fuel product tank for the octane-rich fuel component and a second enriched fuel product tank for the cetane-rich fuel component. A controller is cooperative with one or more of the storage tank, pump assembly, fuel conduit, separation unit and first and second enriched fuel product tanks to direct the flow of at least one of the market fuel, the octane-rich fuel component and the cetane-rich fuel component to the vehicle through the pump assembly based on user input at the customer interface.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
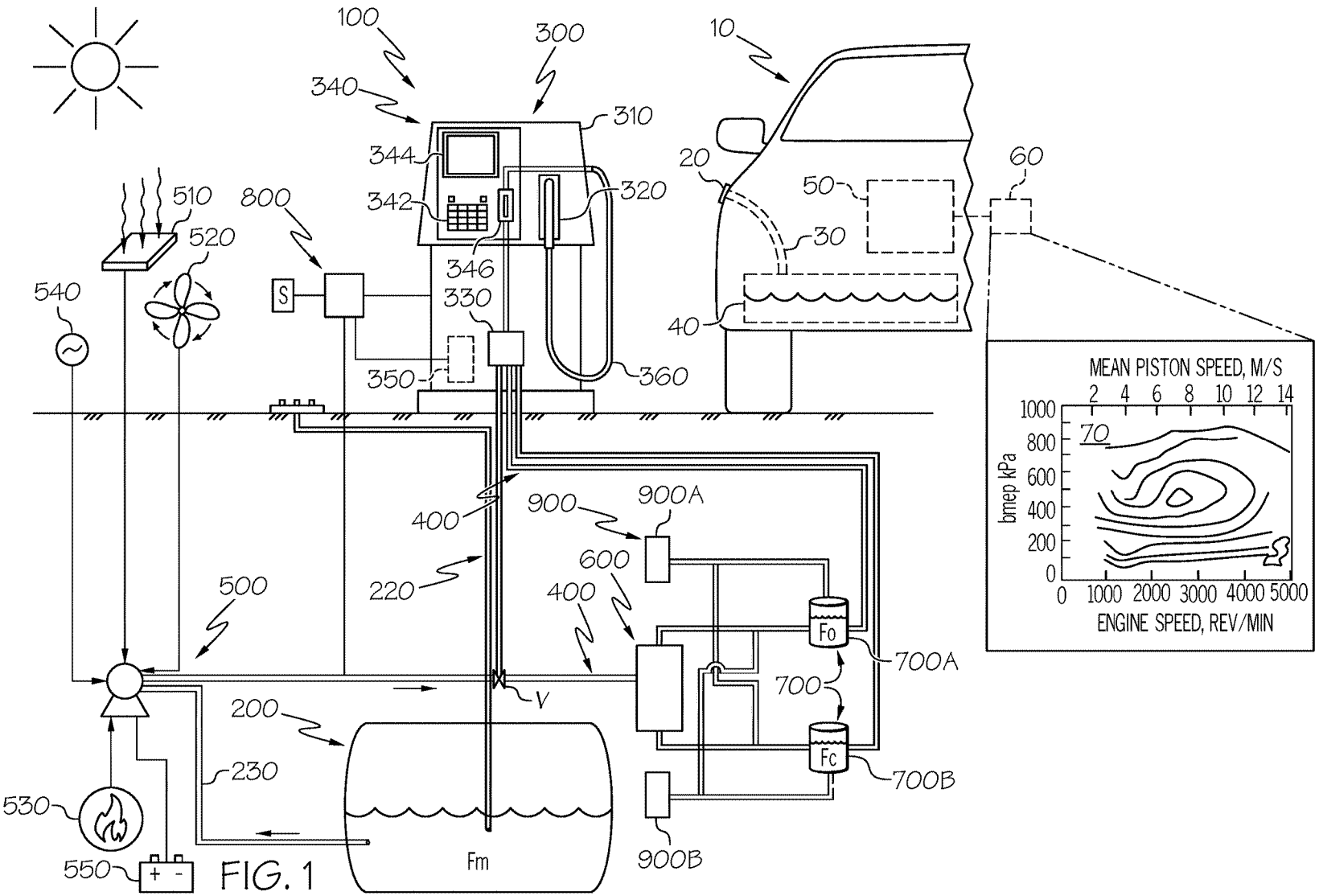
FIG. 1 shows a vehicle placed adjacent a point-of-sale fuel dispensing system in accordance with one or more embodiments shown or described in the present disclosure.

The present disclosure promotes the separation of a single market fuel that is situated at an on-site retail fueling station (also referred to as a filling station) into fuels of different octane or cetane ratings to meet the needs of a vehicle with a particular ICE, regardless of the mode of ICE operation (for example, SI, CI, GCI or the like). While there are numerous separation processes available with which to alter the properties of a market fuel, the authors of the present disclosure believe that extractive-based, volatility-based and membrane-based approaches are particularly well-adapted for use with the disclosed retail point-of-sale system as a way to generate octane-on-demand (OOD) and cetane-on-demand (COD) in order to deliver fuel based on the immediate needs of a particular ICE as dictated by a load-speed map, related performance curve or other operational metric. For example, under low-load operating conditions, an on-demand system can deliver lower octane (for SI engines) or lower cetane (for CI or GCI engines) fuel to the ICE, while under high-load conditions for such engines, it can deliver enhanced quantities of octane or cetane, respectively. Such a system and an approach as contained in the present disclosure has the flexibility to provide a continuous range of fuels of different octane or cetane specifications from a single, local market fuel in a point-of-sale structure that is not present at the refinery and, as such, could not be replicated by merely scaling-down a refinery-based customization operation. Moreover, such point-of-sale structure is dissimilar from point-of-sale blending systems in that redundant infrastructure—such as multiple storage tanks for different grades of market fuel—are not required. In this way, it can provide substantially instantaneous delivery of a fuel that is tailored to the needs of an individual vehicle that in turn avoids or reduces the expenses associated with so-called "octane giveaway", as well as reducing the risk of producing unused fuels.

Within the present context, the term "market fuel" includes those SI or CI fuels that arrive on-site at the filling station or related retail point-of-sale from the refinery or other upstream facility in their conventional ready-to-be-dispensed formulas. For example, and not by way of limitation, a gasoline-based market fuel may possess a research octane number (RON) of roughly 85 to 100, while a diesel-based market fuel may possess a cetane number (CN) of roughly 40 to 60, where both may further include conventional additives such as those for antiknock improvement, cold-flow performance boosters, deposit control, detergents, emissions control, friction reduction or the like. It is contemplated that a market fuel may additionally be subjected to conventional or yet-to-be developed blending or related modification at the point-of-sale.

In one particular form, the ability to produce selective OOD and COD at the point of retail sale permits the owner or operator of such fueling or filling station to use market fuels of relatively low grade (for example, low octane) and separate such fuel on-site as a way to avoid having to keep a large reserve of high grade fuel (with its concomitantly higher processing cost), as well as reduce the environmental impact (such as carbon emissions) associated with large-scale fuel processing activities. Moreover, such localized, readily-available supply of higher grades manufactured at the point of retail sale is useful for original equipment manufacturers (OEMs) in that it allows them more design flexibility to downsize ICEs in an attempt to achieve one or both of better fuel economy and higher performance.

Referring first to FIG. 1, a general view depicting various portions scheme of a point-of-sale fuel dispensing system 100 for use in fueling a vehicle 10 at a retail filling station is shown, where the vehicle 10 includes (among other things) a fuel supply port 20, fuel line 30, fuel tank 40, ICE 50 and electronic control unit (ECU) 60 that can provide at least some operational control over vehicle 10 based on sensed data and known parameters the latter of which can be provided through engine performance maps 70 that are stored in memory as either lookup tables, algorithms or the like. In one form, the engine performance maps 70 and other information contained within or otherwise accessible through memory by the ECU 60 may be used by the vehicle 10 manufacturer in order to recommend to the customer which grade of fuel to select, while in another form, the customer may make such selection based on his or her own known driving habits. Although presently depicted as a conventional passenger vehicle 10 in the form of a sedan, it will be appreciated that other vehicular configurations—including coupes, sport utility vehicles (SUVs) minivans, trucks or the like—are deemed to be within the scope of the present disclosure. In one form, the fuel storage capacity of the fuel tank 40 is between roughly ten gallons and twenty five gallons, although it will be appreciated that such sizes may be larger or smaller, depending on the size of the vehicle 10, and that all such variants are deemed to be within the scope of the present disclosure. Within the present context, the fuel tank 40 is limited to those containers and related vessels that are fluidly coupled to the ICE 50 that is providing propulsive power to vehicle 10. As such, fuel-containing tanks that are situated on or otherwise carried by a vehicle and that are for use in storing fuel in transit rather than as an energy source for the ICE 50 and associated transportation needs of vehicle 10 are not deemed to be fuel tanks for the purpose of the present disclosure. Likewise, such fuel storage capacity of the fuel tank 40 is that which is designed and built in conjunction with the as-manufactured vehicle 10 such that for fueling purposes, an amount of fuel being dispensed from the point-of-sale fuel dispensing system 100 does not exceed such fuel storage capacity of the vehicle 10 and its fuel tank 40.

In one form, the point-of-sale fuel dispensing system 100 is made up of numerous components including a market fuel storage tank 200, a pump assembly (also referred to as a fuel dispenser) 300, fuel conduit 400, an optional fuel pressurizing device 500, separation unit 600, various enriched fuel product tanks (collectively 700, individually 700A, 700B), controller 800, as well as numerous sensors S that can acquire operational data of the various system components. In operation, a vehicle 10 in need of refueling is placed adjacent the pump assembly 300 so that—depending on the grade or specification of the fuel needed to best operate the vehicle 10—a customer may pay for and select an appropriate fuel grade that may be produced and stored on-site. In one form, the grade of fuel selected by the customer may substantially comprise the market fuel $F_M$, while in another form, it may comprise the market fuel $F_M$ that has been augmented by a suitable amount of octane-rich or cetane-rich fuel components $F_O$ and $F_C$ as produced by system 100, as well as the market fuel $F_M$ with or without the inclusion of the octane-rich or cetane-rich fuel components $F_O$ and $F_C$ along with oxygenates (such as ethanol, tertiary butyl alcohol (TBA) or methyl tertiary butyl ether (MTBE)), aromatics (such as benzene, toluene or xylene) or other additives for the octane-rich fuel component $F_O$ or nitrates (for example, 2-ethylhexyl nitrate) or peroxides (for example, di-tertiary-butyl-peroxide) for the cetane-rich fuel component $F_C$, all as will be discussed in more detail elsewhere in the present specification. Within the present context, a fuel or fuel component is deemed to be octane-rich when it has a concentration of iso-octane ($C_8H_{18}$) or other knock-reducing components that is greater than that of the readily-available market fuel $F_M$ from which one or more separation activities have been employed. By way of example, a fuel would be considered to be octane-rich if it had a research octane number (RON) of greater than about 91-92 or an anti-knock index (AKI) of greater than about 85-87 for a so-called regular grade unleaded fuel, with respectively slightly higher values for mid-grade unleaded fuel and premium unleaded fuel. It will likewise be understood that there are regional variations in the values of RON, AKI or other octane or cetane indicia recited in the present disclosure, and that the ones expressly discussed in the previous sentence contemplate a United States market. Nevertheless, such values will be understood to be suitably adjusted to take into consideration these regional variations, and that all such values are deemed to be within the scope of the present disclosure within their respective region, country or related jurisdiction. As with octane, a fuel is deemed to be cetane-rich when it has a concentration of n-cetane ($C_{16}H_{34}$) or fuel component that have high cetane number that is greater than that of the readily-available market fuel $F_M$. By way of example, a fuel would be considered to be cetane-rich if it had a cetane number (CN) of greater than about 40-45 (for most of the United States market, with suitable variations elsewhere). Within the present disclosure, there are various forms of energy that may be used in order to promote the separation of the market fuel $F_M$ in the separation unit 600. In one form, such energy may come in the form of heat such as that needed for volatility-based separation or extraction. In another form, such energy may come in the form of pressure such as from a pump or related mechanical pressurizing device 500; this latter form may be used in conjunction with membrane-based separation processes or any other process that requires additional pressure to the market fuel $F_M$.

In one form, the market fuel storage tank 200 is situated underground on the premises of a retail refueling station, and may be configured as a generally cylindrical-shaped vessel sized to contain between about 1,000 gallons and 30,000 gallons of market fuel $F_M$ that can be introduced through a ground-based fill cap 200A and a fill line 200B. Likewise, market fuel $F_M$ may be withdrawn from the market fuel storage tank 200 through the operation of the fuel pressurizing device 500 working in conjunction with a fuel uptake line 230 that may form a part of fuel conduit 400. In another form (not shown), the market fuel storage tank 200 may be stored above ground on the retail refueling station premises such that either the underground or above ground variants are deemed to be within the scope of the present disclosure.

In one form, the pump assembly 300 includes a housing 310, a nozzle 320 for dispensing fuels to vehicle 10, a valve-based metering device 330 and customer interface 340. Within the present context, the term "customer interface" includes those interfaces that permit a customer to generate commands, data, or other input that can be used by other point-of-sale hardware or software to facilitate the sale and dispensing of fuel and, potentially, other goods and services. In one form, the customer interface 340 includes a keypad 342 or related input device to permit the customer to initiate and pay for a particular fuel purchase, a display screen 344 for displaying visual information, and a card reader 346. In one form, the keypad 342 and display screen 344 may be integrated into a display-based touch-screen or other known graphical user interface with input/output functionality. Likewise, and not by way of limitation, the customer interface 340 may include a wireless communication portal or other input device. Regardless of whether the display screen 344 is integrated with the keypad 342, it may be configured to provide not just fuel grade options, but also whether the fuel being selected includes octane boosters, deposit control additives, combustion modifiers, friction modifiers or the like (for use when the fuel being dispensed exhibits significant gasoline-like properties), as well as cetane boosters, detergents, cold-flow performance additives, lubricity additives or the like (for use when the fuel being dispensed exhibits significant diesel fuel-like properties) are available for dispensing, as well as options for a particular type and amount of such additive to be dispensed. A processor-based controller 350 may be disposed within the housing 310 and coupled to the various components that make up the pump assembly 300 to allow the customer to select the fuel grade, as well as to pay for the fuel being purchased. In one form, the nozzle 320 provides a termination point for a hose 360 or other fluid tube that may make up a portion of fuel conduit 400. Consistent with the use of the point-of-sale fuel dispensing system 100 to deliver gasoline, diesel or related fuels to the roughly ten to twenty five gallon fuel tank 40 (for passenger vehicles), the pump assembly 300 and fuel conduit 400 are sized to accommodate flows of up to about ten to fifteen gallons per minute (subject to various jurisdiction-mandated limitations), whereas for larger tanks (in the case of larger passenger or commercial vehicles, heavy trucks, vans, buses, coaches or the like), the size of the fuel conduit 400 may be made larger (for example, between about thirty and thirty five gallons per minute (again, depending on jurisdiction-imposed limitations).

The metering device 330 may be in the form of a chamber, valve or other configuration disposed in or adjacent the housing 310 to function as a way to optionally introduce oxygenates, aromatics, nitrates, peroxides or other fuel additives that may be stored on-site, such as will be discussed in more detail in conjunction with FIGS. 2 through 4. Likewise, the metering device 330 may also be used in conjunction with controller 350 to ensure that the desired proportion of one or more of the market fuel $F_M$, octane-rich fuel component $F_O$ and cetane-rich fuel component $F_C$ are mixed together in accordance with the fuel grade that has been selected by the customer. In one form, any such mixing based on the customer choice made through the customer interface 340 may be based on correlations to known, predetermined mixed fuel formulas such that these formulas may be retrieved via lookup table in memory or other similar data structures that can be accessed by metering device 330 or controller 350. Likewise, customer-specific information may be stored in memory for use by the controller 800 to expedite subsequent purchases at the same filling station (or other commonly-owned filling stations that share such customer-specific information) through correlation between the each customer's account number or related identifier and a database of previously-purchased fuels. In a similar manner, details associated with the chosen fuel grade—as well as the corresponding cost—may also be visually indicated on the display screen 344 to allow the customer to select the fuel grade and proceed with the desired purchase such that the proper fuel may be conveyed through the fuel conduit 400, metering device 330, hose 360, nozzle 320 and into vehicle 10 though its fuel supply port 20, fuel line 30 and fuel tank 40.

In one form, the fuel pressurizing device 500 is configured as a pump, such as a kinetic-based submersible pump that achieves its pressurizing function through a centrifugally-rotating impeller or a positive-displacement suction pump. In one form, such a pump may perform both the pressurizing function for the market fuel $F_M$ through the fuel conduit 400 and the pump assembly 300 as well as the pressurizing function for the market fuel $F_M$ to pass through the separation unit 600 in order to produce the octane-rich fuel component $F_O$ and cetane-rich fuel component $F_C$. In another form, there may be more than one pump such that one may be dedicated to one or the other of pressurizing market fuel $F_M$ for direct delivery to the pump assembly 300 while another is used or pressurizing market fuel $F_M$ for delivery to the separation unit 600 for the production of the octane-rich fuel component $F_O$ and cetane-rich fuel component $F_C$. Either variant is deemed to be within the scope of the present disclosure.

In one form, energy used to power the fuel pressurizing device (or devices) 500 as a way to support the market fuel $F_M$ separation processes discussed in the present disclosure processes can come from a variety of sources 510, 520, 530 and 540, some of which are renewable. For example, renewable energy sources may include solar energy through a suitable photovoltaic device 510. In another form, such energy may be provided by wind power, such as through wind turbine 520 or other wind-responsive rotary device. In still other forms, the energy source may be provided by geothermal power 530, including dry steam geothermal power stations, flash steam geothermal power stations or the like. Relatedly, the energy may be provided by biomass or hydroelectric sources. In this way, the fuel pressurizing device 500 may in one form be a pump that is adapted to receive electric power from one or more of these renewable energy sources 510, 520, 530 and 540. Likewise, the energy may be provided in nonrenewable forms. For example, non-renewable energy sources may include the burning of fossil fuels in an ICE (such as a ground-based power unit or related stationary version of ICE 50) to generate mechanical power directly or as electrical power that may generate mechanical power indirectly. In another example, such non-renewable energy sources may include a direct supply of electricity from the electrical grid 540 from an electric power generating station or other conventional alternating current power source such that a conventional induction or permanent-magnet electric motor (not shown) is directly coupled to the pump or other fuel pressurizing device 500. The energy may also be converted into a different usable form (such as heat to power or the like) using a suitable conversion device in the form of a motor similar to the previously-mentioned electric motor. Regardless of how the fuel pressurizing device 500 is powered, it can receive the market fuel $F_M$ through the fuel uptake line 230 in order to pressurize it for delivery through portions of the fuel conduit 400 to the separation unit 600. With the exception of energy being provided from the electrical grid 540, the energy sources discussed in conjunction with the point-of-sale fuel dispensing system 100 are available from the filling station's local environment. Within the present context, one or more of the renewable and non-renewable sources of energy can be combined to take advantage of different conditions as a way to ensure that a steady, reliable way to deliver sufficient power to achieve the desired degree of market fuel $F_M$ pressurization and subsequent separation. In another form, the fuel pressurizing device 500 might not be needed, such as those situations associated with the more efficient heat-based separation energy for volatility-based separation or extraction where renewable sources such as solar thermal may be employed.

In situations where there is an excess of energy extracted from the renewable or non-renewable sources 510, 520, 530 and 540 beyond that needed to operate the point-of-sale fuel dispensing system 100, and where such excess energy has been (or can be) converted into electrical form, such excess may also be captured in a storage device 550 that in one form may constitute a charge-storage device such as a battery or the like for later use by the point-of-sale fuel dispensing system 100. Such storage is particularly useful for other operational periods that may coincide with times where such renewable energy source is not immediately available, such as when there is an inadequate amount of wind or sunlight.

The separation unit 600 is fluidly coupled to the fuel pressurizing device (or devices) 500 such that the incoming market fuel $F_M$ is operated upon by one or more reaction chambers that make up the separation unit 600. In one form, the separation unit 600 is configured to have membrane-based or extractive-based reaction chambers. Such configurations avoid the complexity, large energy consumption and additional infrastructure difficulties that are associated with distillation-based and absorption-based approaches, making them particularly applicable for use in the scale required in a retail filling station environment. In one form, the separation unit 600 may be made up of numerous sub-units such that one sub-unit (for example, a membrane-based sub-unit) may be particularly configured to generate a cetane-rich fuel component $F_C$, while another such sub-unit (for example, an extractive-based sub-unit) may be particularly configured to generate an octane-rich fuel component $F_O$. In one form, such sub-units may be configured to work sequentially with one another.

One or both of hydrodynamic-based and diffusion-based mechanisms may be employed in configurations when the reaction chamber or chambers that make up the separation unit 600 include a membrane-based separator. Likewise, the use of such membranes may be used to facilitate pressure difference—driven separating activities and concentration difference—driven separating activities. Such membranes may be generally spiral wound, hollow fiber or other known shapes, while also being made from various polymers, composites, ceramics or other materials that include additives in order to impart particular separating qualities. Likewise, such membranes may be made to selectively pass particular components of a fluid mixture based on various criteria of the fluid itself, such as the polar or non-polar nature of the molecules, molecular weight of the molecules, as well as other chemical or physical properties of such fluid. Moreover, the use of such membranes may be such that chemical potential-difference-driven separating activities are included. All such membrane variants are deemed to be within the scope of the present disclosure, particularly as they relate to separating at least a portion of the market fuel $F_M$ into its octane-rich and cetane-rich fuel components $F_O$, $F_C$ that may be used in ICE 50.

In one form, the reaction chamber or chambers that make up the separation unit 600 include an extractive-based separator, where differences in the solubilities of various compounds within a liquid mixture can be employed along with mixer-based, column-based or centrifugal-based extraction equipment. In this way, the relative solubility difference between the market fuel $F_M$ being introduced and a solvent can be used in either a batchwise or continuous manner in a way that is well-suited to fuel formulations where the fuel components have close boiling points or otherwise exhibit several azeotropes that do not lend themselves to simple distillation-based separation techniques. In addition, various ionic liquids or organic solvents may be used, depending on the precise nature of the components being separated, as is understood by those skilled in the art. Within the context of separation unit 600, the reaction chamber may be configured as a container, vessel or the like to combine a pair of immiscible solvents such that after cessation of agitation or other mixing, the solvents striate, at which time the market fuel $F_M$ is introduced such that a solute such as the octane-rich fuel component $F_O$ may be extracted. In one form, the difference in solubilities of the solvents in the reaction chamber cause a compound that includes the octane-rich solute to transfer from one of the solvents to the other. Moreover, a funnel (not shown) or related device may be used to help with the extraction. As with the membrane-based separation discussed above, all such extractive variants are deemed to be within the scope of the present disclosure, particularly as they relate to separating at least a portion of the market fuel $F_M$ into its octane-rich and cetane-rich fuel components $F_O$, $F_C$ that may be used in ICE 50.

Regardless of the form of separation of the market fuel $F_M$, the effluent octane-rich and cetane-rich fuel components $F_O$ and $F_C$ are then routed through a portion of the fuel conduit 400 into the respective enriched fuel product tanks 700. In one form, the enriched fuel product tanks 700 may hold up to about one percent of the amount of fuel stored in the market fuel storage tank 200 (that is to say, about 400 liters of enriched fuel in situations where the market fuel storage tank 200 contains about 40,000 liters of market fuel $F_M$). Furthermore, the octane-rich and cetane-rich separated fuel components $F_O$ and $F_C$ can optionally receive one or both of an octane additive and a cetane additive that are contained within respective booster tanks 900A, 900B to help tailor the fuel to a desired certain octane or cetane rating prior to being conveyed to the pump assembly 300. In such case, a metering device (as shown in FIG. 2) may be fluidly disposed between the booster tanks 900A, 900B and the enriched fuel product tanks 700 in order to promote the inclusion of the octane booster as an anti-knock agent and the cetane booster as an ignition accelerator. In one form, the booster tanks 900A, 900B may hold up to about five percent of the amount of market fuel $F_M$ that is present within the market fuel tank 200. Thus, in one form, and assuming that most of the fuel separation is conducted while filling, the booster tanks 900A, 900B may be sized to hold about 2,000 liters of additives in situations where the market fuel tank 200 is capable of holding about 40,000 liters.

Controller 800 is used to receive data from sensors S and provide logic-based instructions to the various parts of point-of-sale fuel dispensing system 100. In one form, the controller 800 could manage the fuel flow from either the market fuel storage tank 200 or one or both of the product tanks 700 where the two fuels corresponding to OOD or COD may be injected separately or together, the latter by blending through the metering device 330 at different ratios depending on fuel grade selected by the point-of-sale purchaser. As will be appreciated by those skilled in the art, controller 800 may be a singular unit such as shown notionally in FIG. 1, or one of a distributed set of units throughout the point-of-sale fuel dispensing system 100. In one configuration, controller 800 may be configured to have a more discrete set of operational capabilities associated with a smaller number of component functions such as those associated solely with the operation of the pump assembly 300, while in anther configuration, controller 800 may have a more comprehensive capability such that it acts to control a larger number of components within the point-of-sale fuel dispensing system 100, such as the various pumps, valves, actuators and related flow control devices that define fuel conduit 400, and that all such variants, regardless of the construction and range of functions performed by the controller 800, are deemed to be within the scope of the present disclosure. In one form associated with only performing more discrete functions associated with the operation of the point-of-sale fuel dispensing system 100, the controller 800 may be configured as an application-specific integrated circuit (ASIC). In one form, controller 800 is provided with one or more input/output (I/O) 810, microprocessor or central processing unit (CPU) 820, read-only memory (ROM) 830, random-access memory (RAM) 840, which are respectively connected by a bus 850 to provide connectivity for a logic circuit for the receipt of signal-based data, as well as the sending of commands or related instructions. Various algorithms and related control logic may be stored in the ROM 830 or RAM 840 in manners known to those skilled in the art. Such control logic may be embodied in a preprogrammed algorithm or related program code that can be operated on by controller 800 and then conveyed via I/O 810 to the various components of the point-of-sale fuel dispensing system 100 being acted upon. In one form of I/O 810, signals from the various sensors S are exchanged with controller 800. Sensors may comprise pressure sensors, temperature sensors, optical sensors, acoustic sensors, infrared sensors, microwave sensors, timers or other sensors known in the art for receiving one or more parameters associated with the operation of the point-of-sale fuel dispensing system 100 and associated components.

The controller 800 may be implemented using model predictive control schemes such as the supervisory model predictive control (SMPC) scheme or its variants, or such as multiple-input and multiple-output (MIMO) protocols or the like. In that way, a customer fuel choice such as that entered through customer interface 340 and received by the controller 800 can be compared to a predetermined table, map, matrix or algorithmic value so that based on the desired fuel type, the controller 800 may instruct the other components that make up the point-of-sale fuel dispensing system 100 to adjust or dispense a fuel mixture that best comports with the selected fuel grade. In one form, the operations of the controller 350 (discussed previously in conjunction with the pump assembly 300) may be subsumed into controller 800, while in another form, the controllers 350, 800 may be separate devices that can work in conjunction with one another such that the production of the octane-rich and cetane-rich separated fuel components $F_O$ and $F_C$ are governed by controller 800 while any blending and other dispensing-related functions are governed by controller 350, and that it will be appreciated that either variant is within the scope of the present disclosure.

In one form, controller 800 may be preloaded with various parameters (such as ambient pressure and temperature conditions) into a lookup table that can be included in the ROM 830 or RAM 840. In another form, controller 800 may include one or more equation- or formula-based algorithms that permit the processor 820 to generate a suitable logic-based control signal based on inputs from various sensors, while in yet another form, controller 800 may include both lookup table and algorithm features to promote its fuel monitoring, mixing and dispensing functions. Regardless of which of these forms of data and computation interaction are employed, the controller 800—along with the associated sensors S and associated fuel conduit 400—cooperate such that as a particular customer's fuel need is selected, a suitable adjustment of the market fuel $F_M$ that is present in the market fuel storage tank 200 may be made to provide the amount of octane or cetane enrichment needed by separating the market fuel $F_M$ in the manner discussed.

Significantly, controller 800 is useful in promoting customizable fuel strategies that may be configured for a particular engine operational mode, such as GCI, where taking advantage of a particular fuel's inherent properties (such as—for example—ignition delay which helps to promote additional fuel-air mixing), more efficient, lower-emissions operation of ICE 50 may be achieved. Likewise, a properly-customized fuel being delivered to vehicle 10 through the point-of-sale fuel dispensing system 100 under instructions as provided by controller 800 could be used for the delivery of fuel in PPCI, HCCI, RCCI or related modes of operation of ICE 50, that would benefit from a more precise fuel formulation. In one form, operation of controller 800 may be based on empirical correlations such that desired fuel properties may be predicted. This in turn allows the controller 800 to regulate fuel separation and operating conditions of the system 100.

Figure 2:
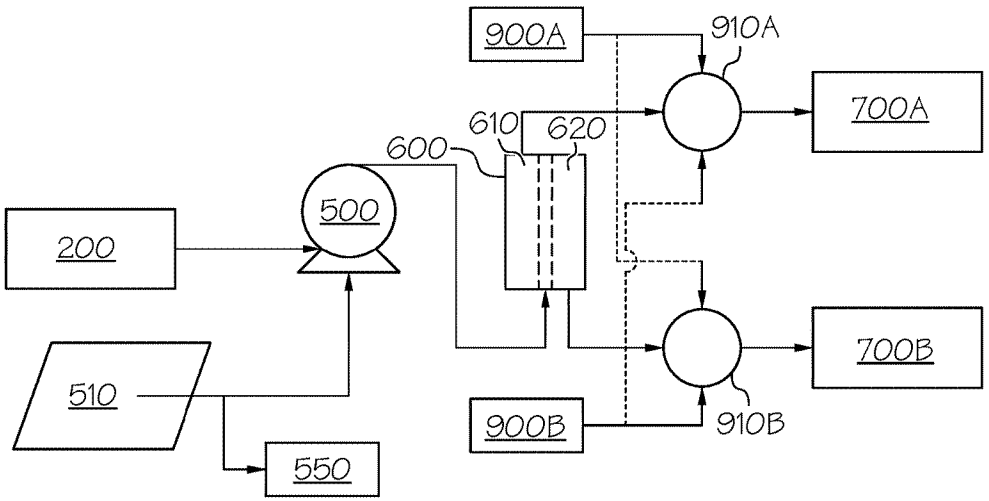
FIG. 2 shows a block diagram with the fluid interconnection of some of the components that make up the point-of-sale fuel dispensing system of FIG. 1 that uses solar energy and a membrane-based fuel separator in accordance with one or more embodiments shown or described in the present disclosure.

Referring next to FIG. 2, a block diagram showing how some of the components that make up the point-of-sale fuel dispensing system 100 cooperate as part of a solar energy-based example of producing OOD or COD fuel. In this example, the sources may include one or more photovoltaic cells 510 that are used to convert solar energy to electrical energy to run the fuel pressurizing device 500 in the form of a pump so that at least some of the market fuel $F_M$ becomes pressurized such that it can be delivered through a portion of the fuel conduit 400 to the separation unit 600 with one or more reaction chambers in the form of a membrane. By such operation, the membrane separates the market fuel $F_M$ into a retentate stream 610 and a permeate stream 620, each of which has a different octane or cetane rating. In one form, the solar energy may be provided in the form of concentrated solar power (CSP) or the like that may be used along with the fuel pressurizing device 500 and separation units 600 to help create the desired octane-rich or cetane-rich fuel components $F_O$, $F_C$. As additionally shown, mixers 910A, 910B may be placed along fuel conduit 400 such that they are fluidly downstream of the separation unit 600 and octane and cetane booster tanks 900A, 900B, while being fluidly upstream of the enriched fuel product tanks 700A, 700B.

Figure 3:
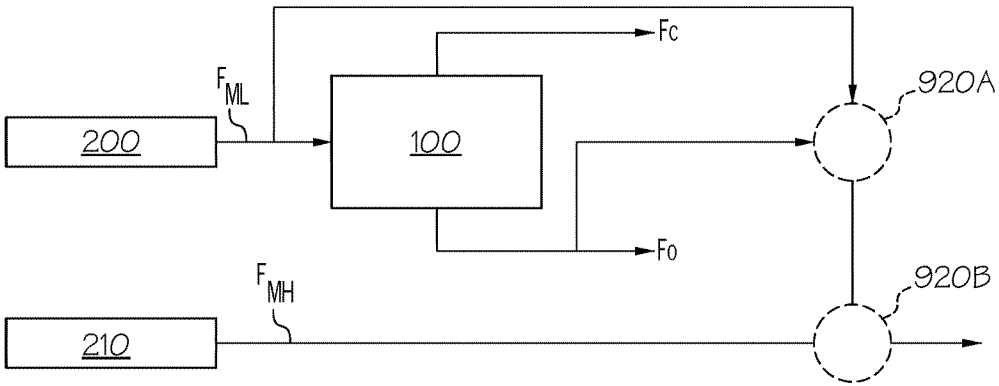
FIG. 3 illustrates a simplified block diagram showing possible fuels that can be created with a point-of-sale fuel dispensing system in accordance with one or more embodiments shown or described in the present disclosure.

Referring next to FIG. 3, an example of some of the many possible fuels that can be created from two notional market fuels where one ($F_{ML}$) originates as a lower RON fuel (for example, 91 RON) while the other ($F_{MH}$) originates as a higher RON fuel (for example, 95 RON) is shown. As mentioned above, in one optional form, the separated (that is to say, octane-rich and cetane-rich) fuel components $F_O$, $F_C$ that are introduced into the enriched fuel product tanks 700A, 700B may be mixed with additional octane or cetane boosters that is stored in the respective octane booster tank 900A and cetane booster tank 900B (all as shown in FIG. 1). In the form shown in FIG. 3, one or the other of the separated octane-rich and cetane-rich fuel components $F_O$, $F_C$ can be blended with the one of the incoming market fuels $F_{ML}$, $F_{MH}$ that was not subjected to the separating actions of the separation unit 600 of FIG. 1 in order to further customize a specific fuel grade for use by the point-of-sale customer. In the particular version depicted in FIG. 3, the separated octane-rich fuel component $F_O$ is shown being blended in mixer 920A with market fuel $F_M$ that is being delivered from the market fuel storage tank 200, as well as optionally in a second mixer 920B with the second (higher RON) market fuel $F_{MH}$ that is being delivered from the additional market fuel storage tank 210. As discussed elsewhere in this disclosure, the cetane-rich fuel component $F_C$ may in one form be used as GCI fuel, while the octane-rich fuel component $F_O$—as well as any blending it may have with the second (higher RON) market fuel $F_{MH}$—can be used as a higher-octane SI fuel, especially in high-performance versions of vehicle 10 that are configured with ICEs 50 that have a high compression ratio. Controller 800 (as shown in FIG. 1) may have suitable logic built in to allow various manipulation of the various valves, pumps and other flow control equipment that makes up the fuel conduit 400 in order to respond to the customer request as entered through the customer interface 340 as a way to provide the desired grade of fuel to the vehicle 10 through the pump assembly 300.

Figure 4:
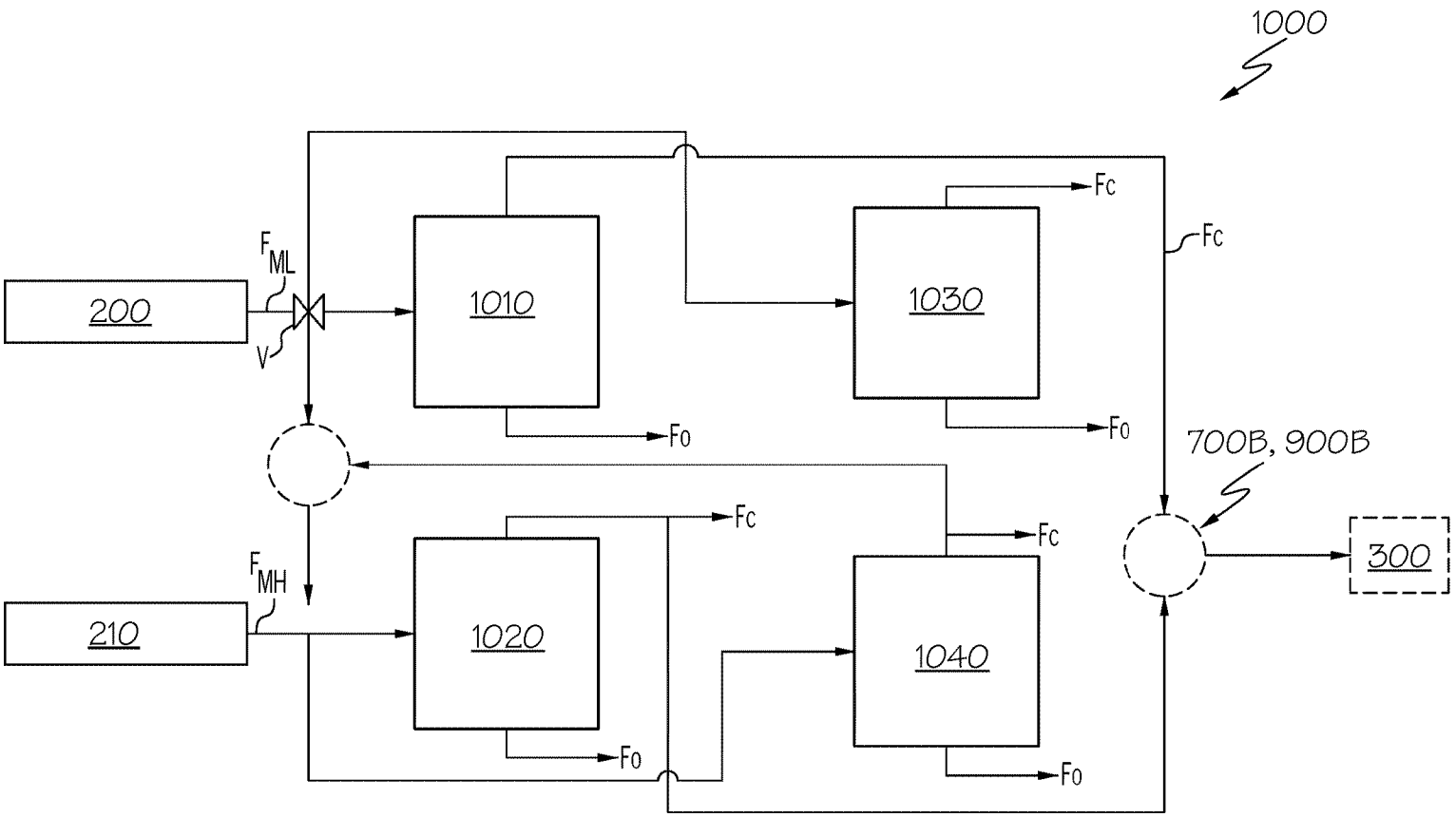
FIG. 4 illustrates a simplified block diagram showing more detailed types of additives that may be included with the possible fuels that can be created with a point-of-sale fuel dispensing system in accordance with one or more embodiments shown or described in the present disclosure.

Referring next to FIG. 4, a network of selective separators and an associated portion of fuel conduit 400 may be used as an example of what can be achieved when the point-of-sale fuel dispensing system 100 is further equipped to perform separation of certain chemical species from either the market fuel $F_M$ or the octane-rich or cetane-rich fuel components $F_O$, $F_C$ is shown. As before, logic embedded in controller 800 may be used along with the various valves, piping and pumps that are used to convey fluids through the fuel conduit 400 to ensure the selective routing of the market fuel $F_M$ or the octane-rich or cetane-rich fuel components $F_O$, $F_C$ being manipulated by such additional equipment. In particular, the additional equipment may be in the form of one or more selective oxygenate separators 1010, 1020 and one or more selective aromatic separators 1030, 1040 all of which may be fluidly disposed along fuel conduit 400 such that they are fluidly downstream of a pair of market fuel storage tanks 200, 210 to receive respective low and relatively high RON fuels $F_{ML}$, $F_{MH}$ in a manner generally similar to that depicted in FIG. 3, while being fluidly upstream of the enriched fuel product tanks 700A, 700B such that any additional separation of oxygenates or aromatics may be performed as a way to further tailor the properties of the low and relatively high RON fuels $F_{ML}$, $F_{MH}$ to a selection made by a purchaser at the customer interface 340.

For example, in situations where the incoming fuel includes two streams a first of which is made up of a lower RON market fuel $F_{ML}$ (for example, 91 RON) coming directly from the market fuel storage tank 200 and a second of which is made up of a higher RON market fuel $F_{MH}$ (for example, 95 RON) coming directly from the additional market fuel storage tank 210, a network of dedicated selective oxygenate separators 1010, 1020 and selective aromatic separators 1030, 1040 may be used to achieve some measure of octane or cetane customization. Although not shown, valving and related fuel flow manipulation approaches may be used to reduce component redundancy of the network of selective oxygenate separators 1010, 1020 and selective aromatic separators 1030, 1040 such that depending on the fuel grade selected, the corresponding incoming market fuel $F_M$ may be routed through one or both of a single oxygenate separator and a single aromatic separator in order to achieve the desired changes in the fuel's octane or cetane number, and that both variants are deemed to be within the scope of the present disclosure. Within the present context, such a network is deemed to be present irrespective of whether each of the aromatic and oxygenate separators is configured as a single unit or multiple units, so long as such selective oxygenate separators 1010, 1020 and selective aromatic separators 1030, 1040 are made to cooperate with the valves, piping and other flow control components associated with the respective portions of the fuel conduit 400 in response to instructions from controller 800 as a way to customize the fuel being delivered to the pump assembly 300 in response to the customer request. In a first path defined by the lower RON market fuel $F_{ML}$, the selective oxygenate separator 1010 acts to bifurcate the stream such that the resulting cetane-rich fuel component $F_C$ and octane-rich fuel component $F_O$ proceed along different paths, the first to either a mixer 910B or one or both of the cetane-rich fuel component tank 700B and cetane booster tank 900B, and the second to either a mixer 910A or the octane booster tank 900A (all as shown in FIG. 1). In another path, the lower RON market fuel $F_{ML}$ may be made (through the operation of valve V) to instead be routed directly to the selective aromatics separator 1030 for similar generation of a cetane-rich fuel component $F_C$ and an octane-rich fuel component $F_O$. Although not shown, the incoming lower RON market fuel $F_{ML}$ may be made to pass in a cascaded manner sequentially through both of the selective oxygenates separator 1010 and the selective aromatics separator 1030, where the choice of the first or second paths is dictated by controller 800 which in turn is based on external factors such as customer choice, local environmental mandates or then like. By being able to follow one of two paths based on the fuel needs, additional fuel customization is possible in that varying degrees of incoming fuel striation in the form of further refinements via selective oxygenates separator 1010 and selective aromatics separator 1030 to either decrease the octane content of a fuel fraction, as well as increase the octane content of the fuel fraction.

Similarly, in situations where the incoming fuel market fuel $F_M$ has a relatively high RON (and hence, a relatively low CN), it may traverse a relatively similar one of the paths through one or both of the selective oxygenates separator 1020 and the selective aromatics separator 1040. In this form, the lower RON effluent (that is to say, a cetane-rich fuel component $F_C$) of the selective oxygenates separator 1020 may be delivered directly through a low RON path to become input for a GCI mode of operation, while the higher RON effluent (that is to say, an octane-rich fuel component $F_O$) may be delivered directly through a high RON path to become input for an SI (particularly a high-performance/high compression ratio) mode of operation. Likewise, in a cascaded path (not shown), the high RON fuel fraction enters the selective aromatics separator 1040 such that additional low and high octane effluent may be delivered to the SI vehicular fuel tank 40 via pump assembly 300. In one form, the octane-rich fuel component $F_O$ (whether rich in aromatics or oxygenates) can be used as an octane booster, high octane fuel, chemical feedstock, power generation fuel, marine fuel or other application where the higher octane rating would be required. Likewise, the cetane-rich fuel component $F_C$ that has a relatively low concentration of aromatics or oxygenates can be used as GCI fuel. Moreover, the various effluents can be mixed together to form a GCI fuel of a different octane rating. Likewise, the concentrations and relative proportions of the oxygenates and aromatics may be blended in a variety of ways to allow the point-of-sale fuel dispensing system 100 to provide a highly customized final fuel product for dispensing.

Figure 5A:
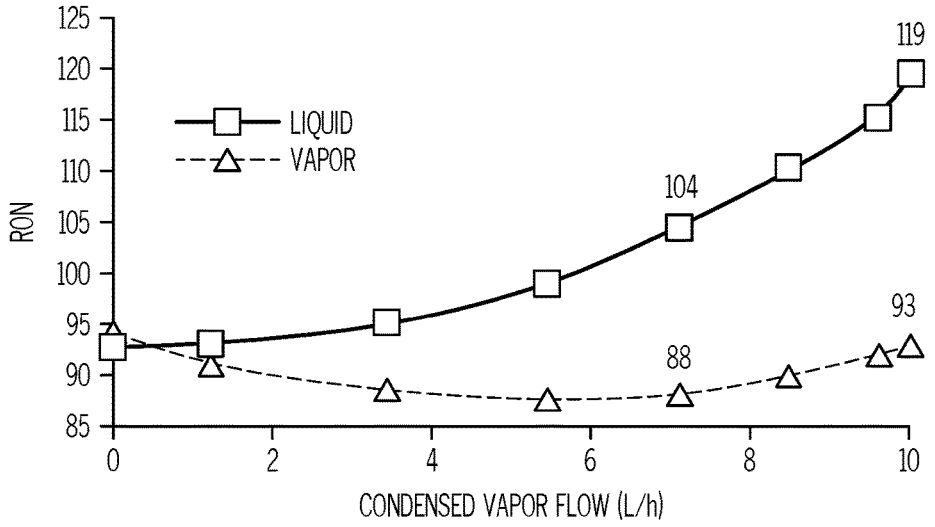
FIG. 5A illustrates an exemplary predicted separation of low and high octane number fuel components that could be achieved by using market fuel separation.
Figure 5B:
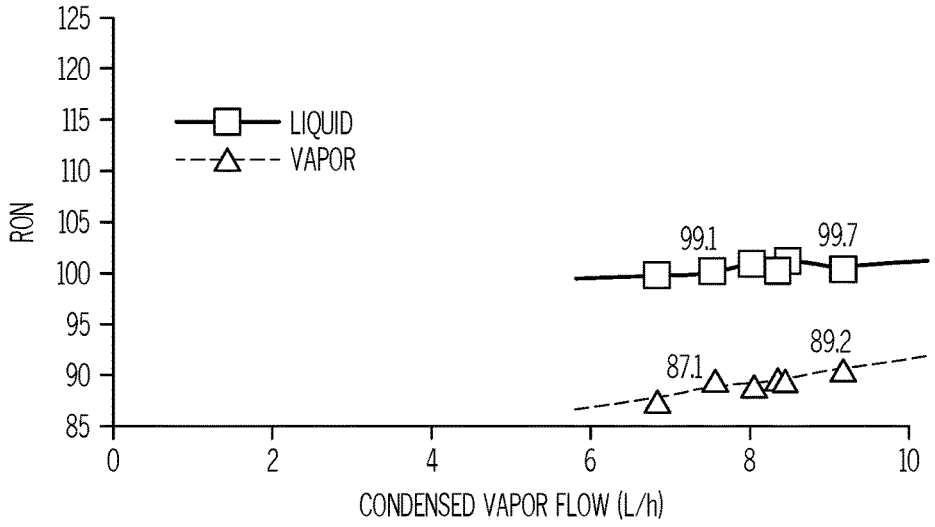
FIG. 5B illustrates an exemplary experimental separation of low and high octane number fuel components that could be achieved by using market fuel separation.

Referring next to FIGS. 5A and 5B, predicted and experimental data collected from pilot plant labs based on flash distillation on two fuels of different grades (in particular, gasoline with octane ratings of 91 RON and 95 RON) is shown. Referring with particularity to FIG. 5A, the results based on an Aspen HYSYS® chemical process simulation software analysis for separating the 91 RON gasoline fuel into octane-rich and cetane-rich fuel components $F_O$, $F_C$ is shown. In particular, it can be seen that the difference in RON between the vapor and liquid phases increases along with the condensed vapor flow that in turn increases as the distillation temperature increases. It is believed that this effect is due to the fact that more of the high octane components remain in the liquid phase while more of the more volatile low octane components enter into the vapor phase. As can also be seen, the octane rating is predicted to increase along with vapor flow increases.

Referring with particularity to FIG. 5B, results for changes in RON based on changes in condensed vapor flow for an input fuel stream of 91 RON gasoline using a flash distillation-based experimental setup is shown. The experimental setup employed flash distillation with which to achieve the fuel separation. Given the similarities in approaches used in distillation in general and flash and extractive distillation in particular with at least the liquid-liquid extraction discussed in this disclosure, it will be appreciated that the changes in octane or cetane levels—if produced by the membrane or extractive techniques mentioned in the present disclosure—would show similar octane bifurcation. In the experiment, separated samples were collected and analyzed in a Cooperative Research Committee (CFR) test engine to determine octane rating. In addition, the samples were profiled using gas chromatography (GC) that showed that fuel separation into different octane ratings can be achieved, and that as vapor flow increases, the octane rating of the octane-rich fuel component $F_O$ also increases. Although there are some deviations from simulation results of FIG. 5A, it is believed that these are due to approximation errors, both the predicted and experimental results show that fuel separation into different octane ratings is feasible. In one form, the fuel represented by the upper curve could be used in a high RON engine such as an SI-configured ICE 50 in general, and a high-compression SI-configured ICE 50 in particular. Likewise, the fuel represented by the lower curve could be used in a low RON engine such as a GCI-configured ICE 50.

Figure 6A:
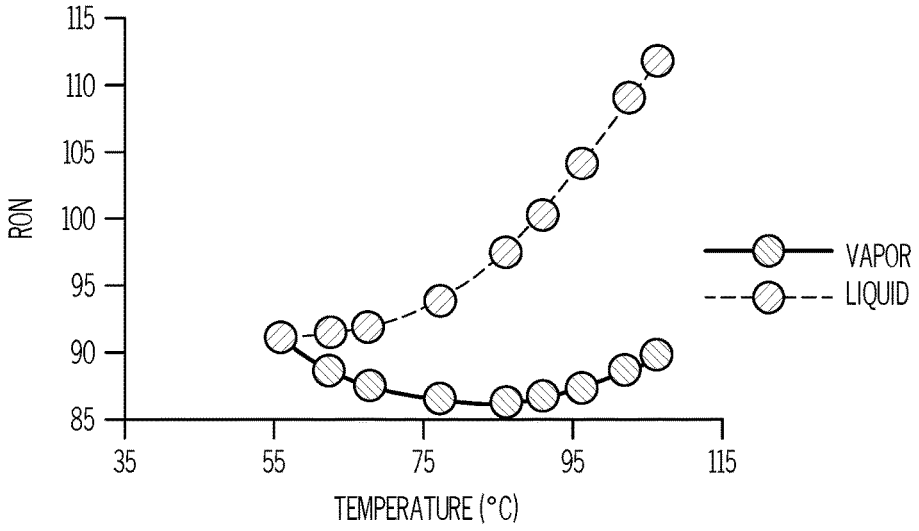
FIGS. 6A and 6B illustrate exemplary predicted separation of low and high octane number fuel components for two seasonal market fuels that could be achieved by using market fuel separation.
Figure 6B:
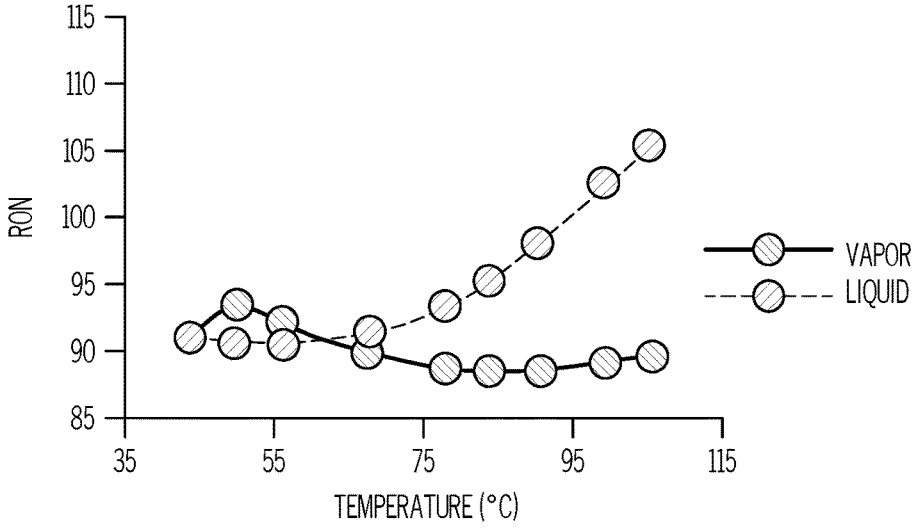

Referring next to FIGS. 6A and 6B, predicted RON changes based on a flash distillation process where increases in flash tank temperature correspond to increases in octane separation for two different US market gasoline samples are shown. In particular, the two fuels represent a summer blend in FIG. 6A and a winter blend in FIG. 6B where such blends may compensate for differences in warm weather and cold weather fuel vapor pressures. These simulation results (also using the Aspen HYSYS® chemical process simulation software analysis) show that although the RON separation performance is different between the two samples, they both indicate that a significant amount of RON separation may be achieved.

Figure 7A:
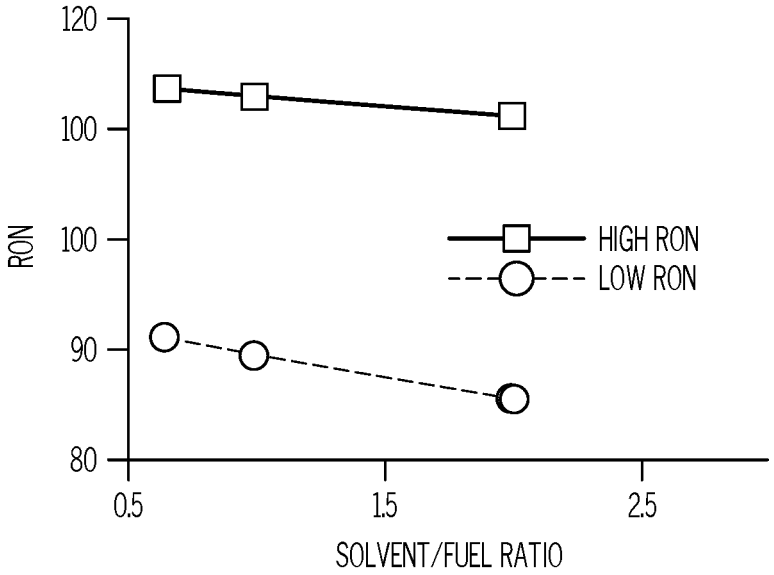
FIGS. 7A and 7B illustrate exemplary predicted separation of low and high octane number fuel components for market fuels with two different octane levels in accordance with one or more embodiments shown or described in the present disclosure.
Figure 7B:
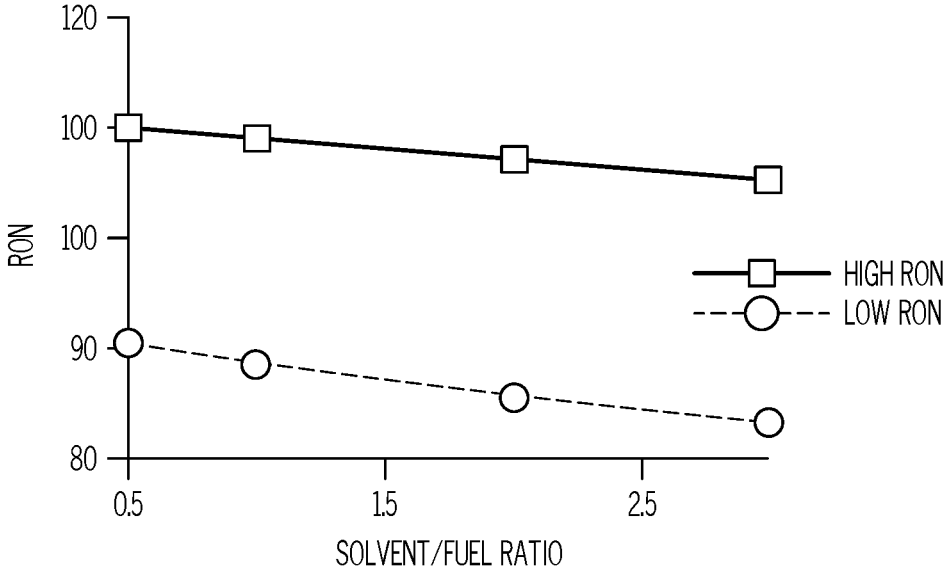

Referring next to FIGS. 7A and 7B, predicted RON separation behavior for two market fuels $F_M$—one with 91 RON and one with 95 RON—using the Aspen HYSYS® chemical process simulation software analysis for a liquid-liquid extraction-based process is shown. The simulation was conducted at two different temperatures (130° C. as shown in FIG. 7A and 170° C. as shown in FIG. 7B) such as that available with heat supplied from a thermoelectric generator (TEG) or the like. In addition, the simulation was conducted using different solvent/fuel ratios. As can be seen, RON separation increases as the flash tank temperature increases, although the impact of changes in the solvent/fuel ratio appears to have only a small to negligible effect on RON separation for both types of gasoline.

Figure 8A:
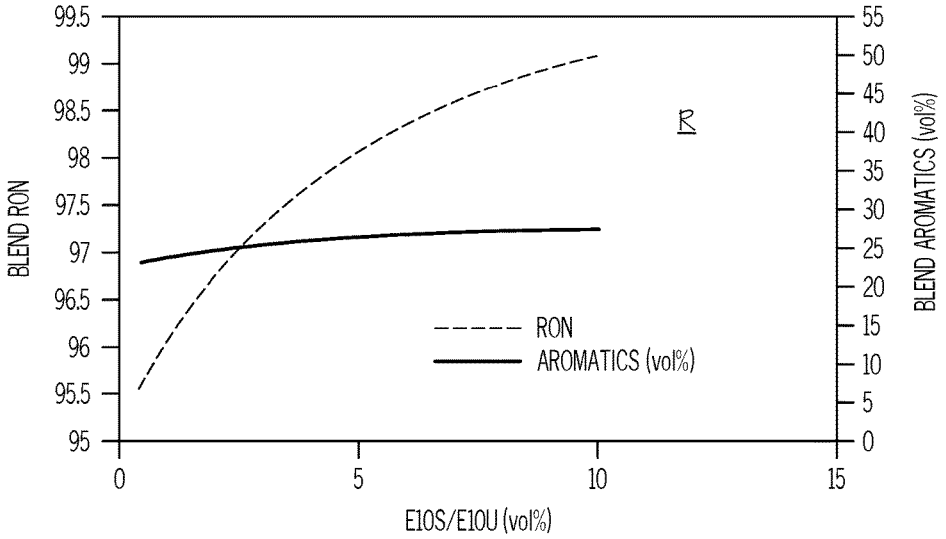
FIGS. 8A and 8B illustrate how blending low and high octane number fuel components can be used to customize increases in gasoline octane levels through the use of either oxygenates or aromatics in accordance with one or more embodiments shown or described in the present disclosure.
Figure 8B:
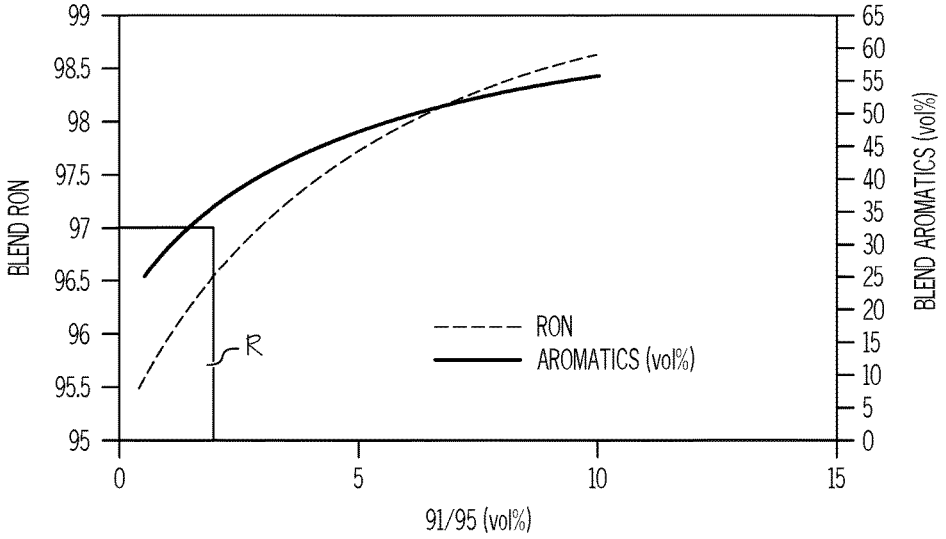

Referring next to FIGS. 8A and 8B, benefits associated with using oxygenates as a way to provide increases in a blended fuel RON are shown. In particular, profiles of aromatics content and RON are shown for the blending of two different market fuels $F_M$. A comparison of the two figures show that other considerations may need to be taken into consideration when trying to meet RON specifications with blended fuels. For example, if a jurisdiction imposes an upper limit on certain compounds (such as aromatics, where its content may be regulated to no more than 35% by volume, as is the case in the United States and Europe) within the market fuel $F_M$, the number of design choices for achieving the desired RON levels in the blended fuel may be limited. In such circumstances, it may be necessary to introduce particular types of additives. Thus, in one form where an upper limit of 35% by volume of aromatics content is assumed (such as that associated with the previously-mentioned jurisdictional mandates), the regions R show where such high and low RON fuel blending is possible without violating aromatics requirement upper limits.

Referring with particularity to FIG. 8A, when blending a pair of E10 ethanol-blended fuels where one (E10S) is a separated relatively high RON fuel and the other (E10U) is an unseparated relatively low RON fuel, a maximum achievable RON may be achieved in all blend ratios, since the high RON fuel is achieved through the inclusion of a relatively high fraction of oxygenates and a relatively low fraction of aromatics. This is evidenced by the fact that the permissible region R spans the entire range of blended fuel combinations. In such circumstance, the use of oxygenates or related bio-components may be beneficial in simultaneously achieving high RON goals while also ensuring that the resulting fuel is not out of compliance with local limitations on aromatics content. Referring with particularity to FIG. 8B, an example of how relying primarily on the use of aromatics as a way to achieve increased blended fuel RON from a combination of low and high RON market fuels $M_F$ is shown. As can be seen, the highest RON that can be obtained is about 97, which can be significantly lower than the approximately 99 RON maximum that can be achieved when there are no limits placed on aromatics content.

Having described the subject matter of the present disclosure in detail and by reference to specific embodiments thereof, it is noted that the various details disclosed should not be taken to imply that these details relate to elements that are essential components of the various embodiments described, even in cases where a particular element is illustrated in each of the drawings that accompany the present description. Further, it will be apparent that modifications and variations are possible without departing from the scope of the present disclosure, including, but not limited to, embodiments defined in the appended claims. More specifically, although some aspects of the present disclosure are identified as preferred or particularly advantageous, it is contemplated that the present disclosure is not necessarily limited to these aspects.

It will be apparent to those skilled in the art that various modifications and variations can be made to the embodiments described in the present disclosure without departing from the spirit and scope of the claimed subject matter. Thus it is intended that the specification cover the modifications and variations of the various embodiments described in the present disclosure provided such modification and variations come within the scope of the appended claims and their equivalents.

What is claimed is:

1. A point-of-sale fuel dispensing system comprising:

a market fuel storage tank;

a pump assembly comprising:

a customer interface for retail payment and fuel grade selection; and a nozzle configured to provide selective fluid coupling to a fuel supply port of a vehicle that is situated adjacent the pump assembly;

fuel conduit cooperative with the pump assembly and the market fuel storage tank to provide selective fluid communication between the pump assembly and the market fuel storage tank;

a separation unit configured to selectively receive and convert at least a portion of a market fuel into an octane-rich fuel component and a cetane-rich fuel component;

a plurality of enriched fuel product tanks disposed fluidly intermediate the separation unit and the pump assembly, the plurality of enriched fuel product tanks comprising:

a first enriched fuel product tank for selectively receiving and containing the octane-rich fuel component; and a second enriched fuel product tank for selectively receiving and containing the cetane-rich fuel component; and a controller cooperative with at least one of the market fuel storage tank, pump assembly, fuel conduit, separation unit and first and second enriched fuel product tanks to direct the flow of at least a portion of at least one of the octane-rich fuel component and the cetane-rich fuel component contained within a respective one of the first and second product tanks through the nozzle based on user input at the customer interface for both retail payment and fuel grade selection for the vehicle, wherein the directed flow does not exceed a fuel storage capacity of the vehicle.

2. The point-of-sale fuel dispensing system of claim 1, wherein the separation unit is selected from the group consisting of a membrane-based separation unit, an extractive-based separation unit, a volatility-based separation unit and combinations thereof.

3. The point-of-sale fuel dispensing system of claim 2, wherein the separation unit comprises a plurality of sub-units comprising a membrane-based sub-unit and an extractive-based sub-unit.

4. The point-of-sale fuel dispensing system of claim 3, wherein the membrane-based sub-unit is configured to provide at least a majority of the cetane-rich fuel component and the extractive-based sub-unit is configured to provide at least a majority of the octane-rich fuel component.

5. The point-of-sale fuel dispensing system of claim 1, further comprising a fuel pressurizing device cooperative with at least one of the market fuel storage tank, pump assembly and the fuel conduit in order to provide an increase in pressure to a market fuel that is contained within at least one of the market fuel storage tank, pump assembly and fuel conduit.

6. The point-of-sale fuel dispensing system of claim 5, wherein the fuel pressurizing device comprises a pump that is adapted to receive electric power from a renewable energy source.

7. The point-of-sale fuel dispensing system of claim 6, wherein the renewable energy source cooperates with the pump to deliver solar energy to at least one photovoltaic cell that is electrically coupled to an electric motor that is rotationally coupled to an impeller within the pump.

8. The point-of-sale fuel dispensing system of claim 6, wherein the renewable energy source cooperates with the pump to deliver wind energy to an electric motor that is rotationally coupled to an impeller within the pump.

9. The point-of-sale fuel dispensing system of claim 6, wherein the renewable energy source cooperates with the pump to deliver geothermal energy to at least one solar cell that is electrically coupled to an electric motor that is rotationally coupled to an impeller within the pump.

10. The point-of-sale fuel dispensing system of claim 6, wherein the renewable energy source cooperates with the pump to deliver hydroelectric energy to power an electric motor that is rotationally coupled to an impeller within the pump.

11. The point-of-sale fuel dispensing system of claim 6, wherein the renewable energy source cooperates with the pump to deliver biomass energy to power an electric motor that is rotationally coupled to an impeller within the pump.

12. The point-of-sale fuel dispensing system of claim 6, wherein the fuel pressurizing device comprises a pump that is powered by a non-renewable energy source.

13. The point-of-sale fuel dispensing system of claim 12, wherein the non-renewable energy source cooperates with the pump to deliver energy produced by the operation of an internal combustion engine that is rotationally coupled to an impeller within the pump.

14. The point-of-sale fuel dispensing system of claim 12, wherein the non-renewable energy source cooperates with the pump to deliver electrical energy produced by the operation of an electric power generating station where electric current delivered from the electric power generating station operates an electric motor that is rotationally coupled to an impeller within the pump.

15. The point-of-sale fuel dispensing system of claim 12, further comprising a battery electrically coupled to at least one of the fuel pressurizing device and an energy source such that electrical energy in excess of that needed for operation of the fuel pressurizing device may be stored in the battery.

16. The point-of-sale fuel dispensing system of claim 1, wherein the fuel conduit and pump assembly are configured to deliver no more than about fifteen gallons of fuel per minute to the vehicle.

17. The point-of-sale fuel dispensing system of claim 1, further comprising a plurality of sensors cooperative with the controller such that operational parameters associated with the fuel dispensing system that are acquired by the plurality of sensors are acted upon by the controller to provide additional operational control of the fuel dispensing system.

18. The point-of-sale fuel dispensing system of claim 1, further comprising:

a supply of an octane booster in selective fluid communication with the first and second enriched fuel product tanks through the fuel conduit; and a supply of a cetane booster in selective fluid communication with the first and second enriched fuel product tanks through the fuel conduit.

19. The point-of-sale fuel dispensing system of claim 18, further comprising a mixer fluidly disposed between a respective one of (a) the supply of an octane booster and the supply of a cetane booster and (b) the first and second enriched fuel product tanks through the fuel conduit.

20. The point-of-sale fuel dispensing system of claim 19, wherein the supply of an octane booster comprise selected from the group consisting of an oxygenate and an aromatic.

21. The point-of-sale fuel dispensing system of claim 19, further comprising an additional market fuel storage tank such that a second market fuel contained within the additional market fuel storage tank may be selectively blended with at least one of the octane-rich fuel component and the cetane-rich fuel component prior to the blended fuel being conveyed through the pump assembly.

22. The point-of-sale fuel dispensing system of claim 21, further comprising a network of selective separator units configured to perform at least one of oxygenate separation and aromatics separation of the market fuel being conveyed from at least one of the market fuel storage tanks prior to delivery to the pump assembly.

23. A system for retail point-of-sale fuel dispensing, the system comprising:

a pump assembly comprising:

a customer interface for retail payment and fuel grade selection; and a nozzle configured to provide selective fluid coupling to a fuel supply port of a vehicle that is situated adjacent the pump assembly;

fuel conduit configured to convey at least a portion of fuel contained within a market fuel storage tank to at least the pump assembly;

a separation unit configured to selectively receive and convert at least a portion of the fuel into an octane-rich fuel component and a cetane-rich fuel component; and a plurality of enriched fuel product tanks disposed fluidly intermediate the separation unit and the pump assembly, the plurality of enriched fuel product tanks comprising:

a first enriched fuel product tank for selectively receiving and containing the octane-rich fuel component; and a second enriched fuel product tank for selectively receiving and containing the cetane-rich fuel component.

24. The system of claim 23, further comprising:

a plurality of sensors configured to acquire operational parameters associated with the pump assembly; and a controller cooperative with the plurality of sensors and at least one of the fuel conduit, separation unit and first and second enriched fuel product tanks to direct the flow of at least a portion of at least one of the octane-rich fuel component and the cetane-rich fuel component contained within a respective one of the first and second product tanks through the nozzle based on user input at the customer interface for both retail payment and fuel grade selection for the vehicle, wherein the directed flow does not exceed a fuel storage capacity of the vehicle.

* * * * *